US011937759B2

(12) United States Patent
Keller

(10) Patent No.: US 11,937,759 B2
(45) Date of Patent: Mar. 26, 2024

(54) VACUUM CLEANER

(71) Applicant: Diversey, Inc., Fort Mill, SC (US)

(72) Inventor: Thomas Keller, St. Gallen (CH)

(73) Assignee: Diversey Switzerland Services GmbH, Muchwilen TG (CH)

( * ) Notice: Subject to any disclaimer, the term of this patent is extended or adjusted under 35 U.S.C. 154(b) by 31 days.

(21) Appl. No.: 17/894,463

(22) Filed: Aug. 24, 2022

(65) Prior Publication Data

US 2022/0400913 A1 Dec. 22, 2022

Related U.S. Application Data

(63) Continuation of application No. 17/470,175, filed on Sep. 9, 2021, now Pat. No. 11,452,412, which is a (Continued)

(30) Foreign Application Priority Data

Apr. 27, 2016 (EP) ..... 16167356

(51) Int. Cl.
*A47L 9/00* (2006.01)
*A47L 5/36* (2006.01)
(Continued)

(52) U.S. Cl.
CPC ..... *A47L 9/0081* (2013.01); *A47L 5/365* (2013.01); *A47L 9/127* (2013.01); *A47L 9/14* (2013.01); *A47L 9/22* (2013.01); *A47L 9/009* (2013.01)

(58) Field of Classification Search
CPC ... A47L 5/00; A47L 5/365; A47L 9/00; A47L 9/0081; A47L 9/009; A47L 9/127; A47L 9/14; A47L 9/22
See application file for complete search history.

(56) References Cited

U.S. PATENT DOCUMENTS 2,441,365 A * 5/1948 McAllister ..... A47L 5/365 55/497
2,507,672 A * 5/1950 McAllister ..... A47L 5/365 55/472
(Continued)

FOREIGN PATENT DOCUMENTS

AT 505890 B1 1/2014
AU 2017256737 B2 8/2019
(Continued)

OTHER PUBLICATIONS

International Search Report and Written Opinion of counterpart Application No. PCT/EP2017/059997 dated Aug. 8, 2017; 9 pages.
(Continued)

*Primary Examiner* — Marc Carlson
(74) *Attorney, Agent, or Firm* — Lorenz & Kopf, LLP

(57) ABSTRACT

A vacuum cleaner (1) comprising a container (2), a suction unit (60), an air channeling unit (25), operative between the container (2) and the suction unit (60), wherein the air channeling unit (25) comprises: a collector (26) having a suction mouth (27) at an intake side of the air channeling unit (25), a deflector (28) positioned at the intake side and radially extending at least over a central portion of the suction mouth (27), the collector (26) and the deflector (28) delimiting a suction channel (29) connecting the suction mouth (27) to an inlet port (22) of the suction unit (60).

27 Claims, 4 Drawing Sheets

Related U.S. Application Data continuation of application No. 16/096,420, filed as application No. PCT/EP2017/059997 on Apr. 26, 2017, now Pat. No. 11,116,369.

(51) Int. Cl.

| | |
|---|---|
| ***A47L 9/12*** | (2006.01) |
| ***A47L 9/14*** | (2006.01) |
| ***A47L 9/22*** | (2006.01) |

(56) References Cited

U.S. PATENT DOCUMENTS 2,731,103 A * 1/1956 Ortega ..... A47L 11/30 55/DIG. 3
3,031,129 A 4/1962 Gaudry
3,236,032 A * 2/1966 Yasukawa ..... A47L 9/20 55/299
3,815,172 A * 6/1974 Fromknect ..... A47L 7/0042 310/58
3,924,291 A 12/1975 Tschudy et al.
3,958,299 A 5/1976 Tschudy
4,072,483 A 2/1978 Doyle, Jr.
4,088,424 A 5/1978 Hyatt et al.
4,356,591 A * 11/1982 Lude ..... A47L 5/365 181/231
4,435,877 A 3/1984 Berfield
4,512,713 A * 4/1985 Berfield ..... A47L 9/0081 15/326
4,533,370 A * 8/1985 Ikezaki ..... A47L 9/0081 15/326
4,655,694 A 4/1987 Berfield
4,665,581 A 5/1987 Oberdorfer
4,851,017 A * 7/1989 Erickson ..... A47L 9/22 55/472
4,970,753 A 11/1990 Herron, Jr.
5,293,664 A * 3/1994 Lim ..... A47L 9/22 15/326
5,343,592 A * 9/1994 Parise ..... A47L 9/185 55/439
5,365,633 A * 11/1994 Sunagawa ..... A47L 9/0081 15/326
5,513,417 A * 5/1996 Kim ..... A47L 9/0081 15/326
5,548,867 A * 8/1996 Hwang ..... A47L 9/0081 15/326
5,567,127 A * 10/1996 Wentz ..... F04D 29/663 417/423.9
5,647,570 A * 7/1997 Berfield ..... A47L 9/0081 15/326
D383,575 S 9/1997 Griffin
5,720,074 A 2/1998 Lee
5,737,797 A * 4/1998 Rittmueller ..... A47L 5/38 15/314
5,991,969 A 11/1999 Lee
6,003,200 A * 12/1999 Potts ..... A47L 7/0028 15/327.2
6,079,076 A * 6/2000 Berfield ..... A47L 7/0028 15/326
6,113,663 A * 9/2000 Liu ..... A47L 9/127 96/321
6,158,083 A * 12/2000 Holsten ..... A47L 9/0081 15/327.6
6,192,551 B1 * 2/2001 Roth ..... A47L 7/0019 15/326
6,249,933 B1 * 6/2001 Berfield ..... F04D 29/106 15/352
6,381,803 B1 * 5/2002 Berfield ..... A47L 5/22 15/422.2
6,451,078 B2 * 9/2002 Berfield ..... A47L 7/0038 55/374
6,779,228 B2 8/2004 Plomteux et al.
7,018,438 B2 3/2006 Duggan
7,258,714 B2 8/2007 Genn et al.
7,427,307 B2 9/2008 Fujiyoshi et al.
7,627,928 B2 * 12/2009 Crevling, Jr. ..... A47L 7/0019 15/326
7,721,385 B2 5/2010 Genn et al.
7,921,510 B2 * 4/2011 Roney ..... A47L 9/22 15/412
8,261,406 B2 * 9/2012 Kunz ..... A47L 9/0081 15/327.2
8,695,161 B2 * 4/2014 Williams ..... A47L 7/0042 15/326
2002/0092123 A1 * 7/2002 Stephens ..... A47L 5/28 15/326
2006/0260091 A1 * 11/2006 Song ..... A47L 9/0081 15/326
2006/0277711 A1 * 12/2006 Hong ..... A47L 9/0081 15/326
2007/0050939 A1 * 3/2007 Dant ..... A47L 9/0081 15/327.2
2007/0067948 A1 * 3/2007 Biere ..... A47L 5/38 15/314
2013/0091812 A1 * 4/2013 Smith ..... A47L 9/1633 55/342.2
2013/0183141 A1 * 7/2013 Tan ..... A47L 5/14 415/119
2014/0096339 A1 4/2014 Niederman
2014/0325789 A1 * 11/2014 Hill ..... F04D 29/668 417/366
2014/0328670 A1 * 11/2014 Lamb ..... F04D 25/06 415/119
2015/0128375 A1 * 5/2015 Tadina ..... A47L 9/22 15/326
2016/0150932 A1 * 6/2016 Foenss ..... A47L 9/2857 15/352
2020/0178740 A1 * 6/2020 Keller ..... A47L 9/22
2022/0031132 A1 * 2/2022 Keller ..... A47L 9/22

FOREIGN PATENT DOCUMENTS

| | | | |
|---|---|---|---|
| AU | 2018260897 | B2 | 8/2019 |
| CA | 3021512 | A1 | 11/2017 |
| CN | 2259129 | Y | 8/1997 |
| CN | 201123781 | Y | 10/2008 |
| CN | 203987868 | U | 12/2014 |
| CN | 204260671 | U | 4/2015 |
| CN | 104840154 | A | 8/2015 |
| CN | 104997463 | A | 10/2015 |
| CN | 105266722 | A | 1/2016 |
| CN | 109068909 | A1 | 12/2018 |
| DE | 3020792 | A1 | 12/1981 |
| DE | 3029351 | A1 | 3/1982 |
| DE | 3517329 | A1 | 11/1986 |
| DE | 3727980 | A1 | 3/1989 |
| DE | 3743081 | A1 | 6/1989 |
| DE | 3815321 | A1 | 11/1989 |
| DE | 4004177 | A1 | 8/1991 |
| DE | 4317715 | C1 | 6/1994 |
| DE | 19616156 | C1 | 10/1997 |
| DE | 19843719 | A1 | 4/1999 |
| DE | 19802345 | A1 | 5/1999 |
| DE | 10237622 | B3 | 2/2004 |
| DE | 102005058940 | B4 | 2/2015 |
| EP | 0382926 | A1 | 8/1990 |
| EP | 0453163 | A1 | 10/1991 |
| EP | 0930042 | B1 | 7/2003 |
| EP | 1559359 | A2 | 8/2005 |
| EP | 1649796 | A2 | 4/2006 |
| EP | 1929914 | A2 | 6/2008 |
| EP | 1969984 | A2 | 9/2008 |
| EP | 2047782 | A2 | 4/2009 |
| EP | 2227998 | A1 | 9/2010 |
| EP | 1685784 | B1 | 1/2011 |
| EP | 1741374 | B1 | 1/2014 |
| EP | 2907435 | A1 | 8/2015 |
| EP | 2907438 | A1 | 8/2015 |
| EP | 3005921 | B1 | 4/2018 |
| EP | 3448218 | B1 | 8/2019 |
| FR | 2402435 | A1 | 4/1979 |

(56) References Cited

FOREIGN PATENT DOCUMENTS

| | | | |
|---|---|---|---|
| FR | 2844697 | A1 | 3/2004 |
| GB | 246039 | A | 1/1926 |
| GB | 386214 | A | 1/1933 |
| GB | 395814 | A | 7/1933 |
| GB | 442663 | A | 2/1936 |
| GB | 713448 | A | 8/1954 |
| GB | 886641 | A | 1/1962 |
| GB | 1396326 | A | 6/1975 |
| GB | 2468151 | A | 9/2010 |
| JP | S51117474 | U | 9/1976 |
| JP | S51126672 | U | 10/1976 |
| JP | S51130667 | U | 10/1976 |
| JP | S5334885 | U | 3/1978 |
| JP | S55148545 | U | 10/1980 |
| JP | S5630857 | U | 3/1981 |
| JP | S61206420 | U | 12/1986 |
| JP | S61279217 | A | 12/1986 |
| JP | H0351024 | A | 3/1991 |
| JP | H11235295 | A | 8/1999 |
| JP | 2004174148 | A | 6/2004 |
| JP | 2008023010 | A | 2/2008 |
| JP | 2009022338 | A | 2/2009 |
| JP | 2012016363 | A | 1/2012 |
| KR | 0136318 | B1 | 4/1998 |
| KR | 0138969 | B1 | 5/1998 |
| KR | 20010014585 | A | 2/2001 |
| WO | 1994004065 | A1 | 3/1994 |
| WO | 2007040976 | A2 | 4/2007 |
| WO | 2008070962 | A1 | 6/2008 |
| WO | 2008070963 | A1 | 6/2008 |
| WO | 2008070964 | A1 | 6/2008 |
| WO | 2008070980 | A1 | 6/2008 |
| WO | 2009026700 | A1 | 3/2009 |
| WO | 2009026714 | A1 | 3/2009 |
| WO | 2009101775 | A1 | 8/2009 |
| WO | 2010026234 | A1 | 3/2010 |
| WO | 2012119221 | A1 | 9/2012 |
| WO | 2013107341 | A1 | 7/2013 |
| WO | 2014131105 | A1 | 9/2014 |
| WO | 2014190888 | A1 | 12/2014 |
| WO | 2016095041 | A1 | 6/2016 |

OTHER PUBLICATIONS

Australian Patent Office Examination Report for counterpart Application No. 2018260897 dated Apr. 5, 2019 (4 pages).

Australian Patent Office Examination Report for counterpart Application No. 2017256737 dated Mar. 29, 2019 (2 pages).

European Patent Office Extended Search Report for counterpart Application No. 16167356.1 dated Oct. 28, 2016 (7 pages).

Office Action of counterpart Chinese Application No. 201780025906.0 dated Jun. 19, 2020; 8 pages.

Office Action of counterpart EP Application No. 16167356.1 dated May 18, 2020; 4 pages.

Intention to Grant European patent application No. 16167356.1 dated Dec. 1, 2020; 40 pages.

Intention to Grant European patent application No. 17720103.5 dated Apr. 2, 2019; 34 pages.

A. Bhatia, "HVAC—How to Size and Design Ducts," Nov. 2014, p. 48 (Year: 2014).

* cited by examiner

VACUUM CLEANER

CROSS REFERENCE TO RELATED APPLICATIONS

This application is a continuation of U.S. patent application Ser. No. 17/470,175 filed Sep. 9, 2021; which is a continuation of U.S. National Stage patent application Ser. No. 16/096,420 filed under 35 U.S.C. § 371 of International Application No. PCT/EP2017/059997, filed Apr. 26, 2017 and granted as U.S. Pat. No. 11,116,369; which claims priority to European Patent Application No. 16167356.1, filed Apr. 27, 2016, and granted as EP3238592 on Jun. 2, 2021. The subject continuation application is related to divisional European Patent Application No. 17720103.5 filed Oct. 9, 2018 and granted as EP3448218 on Aug. 28, 2019. The contents of all applications are hereby incorporated by reference in their entirety.

TECHNICAL FIELD

The present disclosure relates to the field of vacuum cleaners.

BACKGROUND ART

Vacuum cleaners are used for removing debris from an environment to be cleaned and for collecting the removed debris.

Vacuum cleaners conventionally consist of a collection tank or canister, often mounted on wheels or casters, and a cover or lid upon which a motor and impeller assembly is mounted. The motor and impeller assembly creates a suction within the canister, such that debris are drawn into the canister through an air inlet to which a hose can be attached. A filter within the canister prevents incoming debris from escaping from the canister while allowing filtered air to be forcibly expelled through an air outlet. In certain vacuum cleaners a filter bag into which debris is accumulated is present in the canister: the filter bag has a hole which is positioned at the canister air inlet and traps all incoming debris.

In conventional vacuum cleaners several factors contribute to generate noise, namely:

- the motor and bladed impeller assembly, which operates at relatively high speeds, may be very noisy,
- vibrations induced on the vacuum cleaner chassis and support structures may also cause noise,
- air flows through the inlet and outlet conduits may further contribute to noise generation.

On the other hand, reducing the speed of rotation of the impeller or reducing the velocity of air in the conduits may have deleterious effects upon the operation and performance of the vacuum cleaner.

SUMMARY OF THE INVENTION

In view of the foregoing, an object of the present invention is that of offering a vacuum cleaner appliance configured to achieve a reduction in operating noise without adversely affecting the operational performance of the appliance.

An auxiliary object of the invention is to achieve a reduction in operating noise without adversely affecting the operational performance of the appliance in a vacuum cleaner of the type having a canister housing a filter bag. In particular, it is an ancillary object of the invention conceiving a vacuum cleaner of the type just described which, on the one hand, has an efficient air inflow system and, on the other hand, does not negatively affect the ability of the canister to properly house the collecting bag.

Another object of the invention is a vacuum cleaner where the geometry of the air channeling is prone to minimize noise generated by vibrations and acoustically isolate in an efficient manner the motor-impeller assembly.

Furthermore an aim of the present invention is to provide a vacuum cleaner, which presents a relatively simple design and which can be easily serviced and operated.

One or more of the above objects are substantially reached by a vacuum cleaner according to any one of the appended claims.

Further aspects of the invention are discloses herein below.

A $1^{st}$ aspect concerns a vacuum cleaner (1) comprising a container (2) delimiting an inner collection volume (3); a suction unit (60) provided with a motor (20) and an impeller (21) coupled with the motor (20), the suction unit (60) having at least one inlet port (22), at an impeller inlet side, and at least one outlet port (23), at an impeller outlet side; and an air channeling unit (25), operative between the container (2) and the suction unit (60), having an intake side facing the inner collection volume (3), wherein the air channeling unit (25) comprises: a collector (26) having a suction mouth (27) at said intake side of the air channeling unit (25), a deflector (28), the collector (26) and the deflector (28) delimiting a suction channel (29) connecting the suction mouth (27) to the inlet port (22) of the suction unit (60).

In a $2^{nd}$ aspect according to the $1^{st}$ aspect the deflector is positioned at said intake side and radially extends at least over a central portion of the suction mouth (27).

In a $3^{rd}$ aspect according to any one of the preceding aspects, the deflector presents axial symmetry and is centered inside the suction mouth (27).

In a $4^{th}$ aspect according to any one of the preceding aspects, the collector (26) presents a peripheral wall (30) having a front edge (31) delimiting an outer perimeter of the suction mouth (27).

In a $5^{th}$ aspect according to the preceding aspect, the deflector (28) presents a base wall (32), directed transverse to the peripheral wall (30) of the collector (26), and a side wall (33) emerging from a periphery of the base wall (32) and extending transverse to the base wall (32).

In a $6^{th}$ aspect according to the preceding aspect, the deflector base wall (32) has a non-flat, convex active surface, with convexity facing the collection volume (3) configured to facilitate airflow deflection towards the periphery of the base wall (32).

In a $7^{th}$ aspect according to any one of the preceding two aspects, a curved wall portion (34) connects the base wall (32) to the side wall (33).

In an $8^{th}$ aspect according to the preceding aspect, the curved wall portion (34) confers a bowl shape to the deflector (28), said curved wall portion (34) being configured to facilitate air flow deflection into the suction channel (29).

In a $9^{th}$ aspect according to any one of the preceding aspects the suction mouth (27) has radial size greater than that of the deflector (28).

In a $10^{th}$ aspect according to any one of the preceding aspects, the deflector (28) has a radial size greater than that of the suction unit (60) inlet port (22).

In an $11^{th}$ aspect according to any one of the preceding aspects, the deflector (28) has radial size greater than that of the impeller (21).

In a 12$^{th}$ aspect according to any one of the preceding aspects from the 4$^{th}$ to the 11$^{th}$ the suction channel (29) comprises a first tract (36) starting at the suction mouth (27) and upwardly spanning between the side wall (33) of the deflector (28) and the peripheral wall (30) of the collector (26).

In a 13$^{th}$ aspect according to the preceding aspect, the first tract (36) delimits a respective airflow volume of tubular shape and—proceeding in the flow direction (i.e. the direction of flow taken by air when the suction unit is operative)—presents a continuously decreasing fluid passage cross section.

In a 14$^{th}$ aspect according to any one of the preceding two aspect, the collector (26) comprises an inner wall (35), which is located radially inside the peripheral wall (30) of the same collector (26), and wherein the side wall (33) of the deflector (28) is positioned between the peripheral wall (30) and the inner wall (35) of the collector (26), the suction channel (29) comprising a second tract (37) consecutive to and downstream of the first tract (36)—proceeding in the flow direction (i.e. the direction of flow taken by air when the suction unit is operative).

In a 15$^{th}$ aspect according to the preceding aspect, the second tract (37) extends downwardly between the inner wall (35) of the collector (26) and the side wall (33) of the deflector (28).

In a 16$^{th}$ aspect according to any one of the preceding two aspects, the second tract (37) delimits a respective airflow volume of tubular shape and—proceeding in the flow direction (i.e. the direction of flow taken by air when the suction unit is operative)—presents a continuously decreasing fluid passage cross section.

In a 17$^{th}$ aspect according to any one of the preceding three aspects, the second tract (37) presents an initial portion having width (A3) of fluid passage cross section greater than the fluid passage cross section of width (A2) of the end portion of the first tract (36).

In a 18$^{th}$ aspect according to any one of the preceding four aspects, the suction channel (29) comprises an upwardly directed third tract (38), consecutive to and downstream of (again referring to the air flow direction) the second tract (37) and placing into fluid communication an end of the second tract (37) with the inlet port (22) of the suction unit (60).

In a 19$^{th}$ aspect according to the preceding aspect, the third tract (38) delimits a respective airflow volume of non-tubular shape.

In a 20$^{th}$ aspect according to any one of the preceding two aspects, the third tract (38) has a width (A5) of fluid passage cross section greater than the fluid passage cross section of width (A4) of the end portion of the second tract (37).

In a 21$^{st}$ aspect according to any one of the preceding three aspects, the third tract (38) has a width (A5) of fluid passage cross section greater than the fluid passage cross section of the width (A6) of the inlet port (22) of the suction unit (60).

In a 22$^{nd}$ aspect according to any one of the preceding aspects, the impeller (21) and the motor (20) are arranged one behind the other in an axial direction defining a central axis of symmetry (100).

In a 23$^{rd}$ aspect according to the preceding aspect, the first tract (36), the second tract (37) and the third tract (38) are positioned and configured such as to be symmetric with respect to an ideal plane of symmetry passing through said central axis of symmetry (100).

In a 24$^{th}$ aspect according to any one of the preceding two aspects, the deflector (28) and the collector (26) present a geometry of a solid of revolution, are coaxially positioned, and are symmetric with respect to said ideal plane and/or to said central axis of symmetry.

In a 25$^{th}$ aspect according to any one of the preceding three aspects, the first tract (36), the second tract (37), the third tract (38) and the inlet port (22) are concentrically positioned.

In a 26$^{th}$ aspect according to any one of the preceding four aspects, the suction unit (25) has a compact axial size with maximum axial extension defined by a maximum axial extension of the peripheral wall (30) of the collector (26), the first tract, second tract and third tract being axially contained within the maximum axial extension of the peripheral wall.

In a 27$^{th}$ aspect according to any one of the preceding aspects from the 12$^{th}$ to the 26$^{th}$, the suction channel (29) presents a first width (A1) of first tract (36), a second width (A2) of fluid flow transition over the end of side wall (33) and between first tract (36) and second tract (37), a third width (A3) of second tract (37), a fourth width (A4) of fluid flow transition over the end of an exterior wall portion (35*a*) of inner wall (35) and between second tract (37) and third tract (38), a firth width (A5) of interior wall portion (35*b*) of inner wall (35), and a sixth width (A6) of inlet port (22).

In a 28$^{th}$ aspect according to preceding aspect, the ratio of first and second widths (A1/A2) is 1.3 or higher.

In a 29$^{th}$ aspect according to any one of the preceding two aspects, the ratio of third and second widths (A3/A2) is 1.3 or higher.

In a 30$^{th}$ aspect according to any one of the preceding three aspects, the ratio of third and fourth widths (A3/A4) is 1.3 or higher.

In a 31$^{st}$ aspect according to any one of the preceding four aspects, the ratio of fifth and fourth widths (A5/A4) is 1.3 or higher.

In a 32$^{nd}$ aspect according to any one of the preceding five aspects, the ratio of fifth and sixth widths (A5/A6) is 1.3 or higher.

In a 33$^{rd}$ aspect according to any one of the preceding aspects from the 12$^{th}$ to the 31$^{st}$, the first tract, the second tract and the third tract (36, 37, 38) are concentric and intersect a horizontal plane common to the inlet (22).

In a 34$^{th}$ aspect according to any one of the preceding aspects, from the 12$^{th}$ to the 33$^{rd}$, the suction unit (60) is configured and positioned relative to the air channeling unit (25) such that—when the motor (20) is operated—the impeller (21) causes a suction flow which sequentially follows the following flow path:

from the inner collection volume (3) through the suction mouth (27),
then upwardly through the first tract (36),
then downwardly through the second tract (37),
then upwardly through the third tract (38),
then upwardly through the inlet port (22) of the suction unit (60), the impeller (21) and along an outside of the motor (20).

In a 35$^{th}$ aspect according to any one of the preceding aspects, the vacuum cleaner comprises an exhaust unit (39) including: a collection chamber (40) defining a substantially annular airflow volume concentric with said suction unit (60) and positioned around one or more outlet ports of the suction unit (60) to collect air coming from the impeller (21) and convey collected air to an outlet port (41) of the collection chamber (40).

In a 36$^{th}$ aspect according to the preceding aspect the exhaust unit includes two opposed exhaust channels (42), each of the two channels surrounding a respective portion of the collection chamber (40) and having an intake end (43), in correspondence of the outlet port (41) of said collection chamber (40), and an outlet end (44), opposed to the intake end (43) to discharge air drawn in by the suction unit (60).

In a 37$^{th}$ aspect according to any one of the preceding two aspects, the two exhaust channels are symmetrically opposed and substantially identical the one to the other.

In a 38$^{th}$ aspect according to any one of the preceding three aspects the outlet end (44) of each of the two exhaust channels (42) is separate and spaced from the outlet end (44) of the other of the two exhaust channels (42) thereby forming two distinct and spaced apart air discharge openings.

In a 39$^{th}$ aspect according to any one of the preceding four aspects an air filter is located at each outlet end of each one of the two exhaust channels.

In a 40$^{th}$ aspect according to any one of the preceding five aspects, the vacuum cleaner has an alveolar pad (46), optionally a foam pad, covering an inner surface (40*a*) of the collection chamber (40) surrounding the suction unit (60).

In a 41$^{st}$ aspect according to the preceding aspect, the vacuum cleaner has a further alveolar pad (47), optionally a further foam pad, at least covering inner surfaces (42*a*) of said two exhaust channels (42) facing the collection chamber (40).

In a 42$^{nd}$ aspect according to any one of preceding aspects from the 14$^{th}$ to the 41$^{st}$ the inner wall (35) of the collector (26) comprises a radially inner terminal portion forming an annular seat, of U-shaped cross section, configured to receive a foot portion of an annular support body (48), optionally made in elastomeric material, having a head portion supporting a first axial end the suction unit (60).

In a 43$^{rd}$ aspect according to any one of the preceding aspects from the 14$^{th}$ to the 42$^{nd}$, the vacuum cleaner has a further support body (51), optionally in elastomeric material, having a foot portion received in an auxiliary seat of the air exhaust unit and a head portion active on an second axial end of the suction unit axially opposite to the first axial end.

In a 44$^{th}$ aspect according to the preceding aspect, the head portion of the of the further support body—in cooperation with the head portion of the annular support body—is configured and positioned for maintaining the suction unit (60) above the container.

In a 45$^{th}$ aspect according to any one of the preceding aspects from the 14$^{th}$ to the 44$^{th}$, the deflector (28) is suspended in the middle of the suction mouth (27) and supported by a number of connecting elements (55) active on a side of the deflector (28) opposite the collection volume (3).

In a 46$^{th}$ aspect according to the preceding aspect, the first tract (36) and the second tract (37) form together a continuous and constantly tubular airflow volume, which—proceeding radially from outside to inside—defines an upwardly and then downwardly directed continuous and unobstructed flow path. In other words, no support elements are connect the deflector to the peripheral wall in a way to partially or totally obstruct said continuous tubular air flow volume.

In a 47$^{th}$ aspect according to the preceding aspect, the connecting elements (55) connect the deflector (28) to the inner wall (35) of the collector (26).

In a 48$^{th}$ aspect according to the preceding aspect, the connecting elements (55) connect the deflector (28) to a radially inner terminal portion of the inner wall (35).

In a 49$^{th}$ aspect according to any one of the preceding aspects, the vacuum cleaner includes a suction hose (5) configured to be connected at an aperture (6) of the container and a collecting bag (8) configured to be housed inside the container and presenting an inlet opening (5*a*) configured to be tightly engaged at the aperture (6) present in the container (2) such as to receive the debris collected via the suction hose.

In a 50$^{th}$ aspect according to any one of the preceding aspects, the collector presents an indent (26*a*) reducing an axial length of the peripheral wall (30) at least for a portion of a peripheral wall perimeter.

In a 51$^{st}$ aspect according to any one of the preceding aspects, the vacuum cleaner includes a head assembly (9)—including at least the suction unit (60), the air channeling unit (25) and optionally the exhaust unit (39)—removably coupled to a main opening (10) of the container (2).

In a 52$^{nd}$ aspect according to the preceding aspect, the vacuum cleaner has a filter (14) extending across the main opening (10) of the container (2) and interposed between the container (2) and the head assembly (9).

In a 53$^{rd}$ aspect according to the preceding aspect the filter (14) includes a support structure (15) carrying a filtering membrane (16).

In a 54$^{th}$ aspect according to the preceding aspect, the support structure (15) of the filter (14) presents a peripheral frame (17) coupled, optionally detachably coupled, to the head assembly (9), and a grid portion (18) fixed to the peripheral frame (17) and presenting a plurality of through apertures (19).

In a 55$^{th}$ aspect according to any one of the preceding three aspects, the filter (14) has a basket like overall conformation such that, when the head assembly (9) is coupled to the container (2), the filter (14) extends at least in part inside the collection volume and presents a concavity directed towards the head assembly (9).

A 56$^{th}$ aspect concerns a vacuum cleaner (1) comprising a container (2) delimiting an inner collection volume (3); a suction unit (60) provided with a motor (20) and an impeller (21) coupled with the motor (20), the suction unit (60) having at least one inlet port (22), at an impeller inlet side, and at least one outlet port (23), at an impeller outlet side; and an air channeling unit (25), operative between the container (2) and the suction unit (60), having an intake side facing the inner collection volume (3), wherein the vacuum cleaner further comprises an exhaust unit (39) including: a collection chamber (40) defining a substantially annular airflow volume concentric with said suction unit (60) and positioned around one or more outlet ports of the suction unit (60) to collect air coming from the impeller (21) and convey collected air to an outlet port (41) of the collection chamber (40), and two opposed exhaust channels (42), each of the two channels surrounding a respective portion of the collection chamber (40) and having an intake end (43), in correspondence of the outlet port (41) of said collection chamber (40), and a respective outlet end (44), opposed to the intake end (43) to discharge air drawn in by the suction unit (60).

In a 57$^{th}$ aspect the vacuum cleaner of the 56$^{th}$ aspect comprises the features of any one of aspects from the 1$^{st}$ to the 55$^{th}$.

In a 58$^{th}$ aspect according to one of the preceding two aspects, the two exhaust channels are symmetrically opposed and substantially identical the one to the other.

In a 58$^{th}$ aspect according to any one of the preceding three aspects the outlet end (44) of each of the two exhaust channels (42) is separate and spaced from the outlet end (44) of the other of the two exhaust channels (42) thereby forming two distinct and spaced apart air discharge openings.

In a 59$^{th}$ aspect according to any one of the preceding four aspects a respective outlet filter (45) is located at each outlet end of each one of the two exhaust channels.

In a 60$^{th}$ aspect according to any one of the preceding five aspects, the vacuum cleaner has an alveolar pad (46), optionally a foam pad, covering an inner surface (40*a*) of the collection chamber (40) surrounding the suction unit (60).

In a 61$^{st}$ aspect according to the preceding aspect, the vacuum cleaner has a further alveolar pad (47), optionally a further foam pad, at least covering inner surfaces (42*a*) of said two exhaust channels (42) facing the collection chamber (40).

In a 62$^{nd}$ aspect according to any one of the preceding seven aspects the exhaust unit comprises a flow diverter (61), optionally V shaped, positioned in front of said outlet port (41) and configured to divide the flow exiting from the same outlet port into respective flow streams directed into said two exhaust channels (42).

In a 63$^{rd}$ aspect according to any one of the preceding eight aspects the outlet end (44) of each exhaust channel comprises a diverging portion (44*a*) which is divergent in shape proceeding away from the intake end (43) and a constant cross section portion (44*b*) consecutive to the diverging portion.

In a 64$^{th}$ aspect according to the preceding aspect, the constant cross section portion (44*b*) has a flow passage cross section sensibly larger than that of the intake end and terminates at the outlet filters conferring to air flow a direction perpendicular to a front surface of each one of said outlet filters.

BRIEF DESCRIPTION OF DRAWINGS

Aspects of the present invention will become apparent by reading the following detailed description, given by way of example and not of limitation, to be read with reference to the accompanying drawings, wherein.

DEFINITIONS AND CONVENTIONS

In the following description and in the claims the terms listed below have the following specific meaning.

Vertical, horizontal, top, down, upwardly, downwardly: these terms refer to a normal condition of operation of the vacuum cleaner during use, with the head assembly tightly coupled to the container.

Upstream and downstream: refer to the position of parts in relation to the airflow during operation of the vacuum cleaner.

Airflow volume: a volume which is occupied by air.

Tubular: refers to a body or to an airflow volume having an annular (i.e., closed but not necessarily round) cross section.

The widths A1 to A6 and the areas of the fluid passage cross section widths A1, A3, A5 to A6 are measured perpendicular to the axis of symmetry and of rotation 100 of the impeller, while widths A2 and A4 are measured parallel to said axis 100.

Certain components may only be schematically represented and may not be in scale.

DETAILED DESCRIPTION

Figure 1:
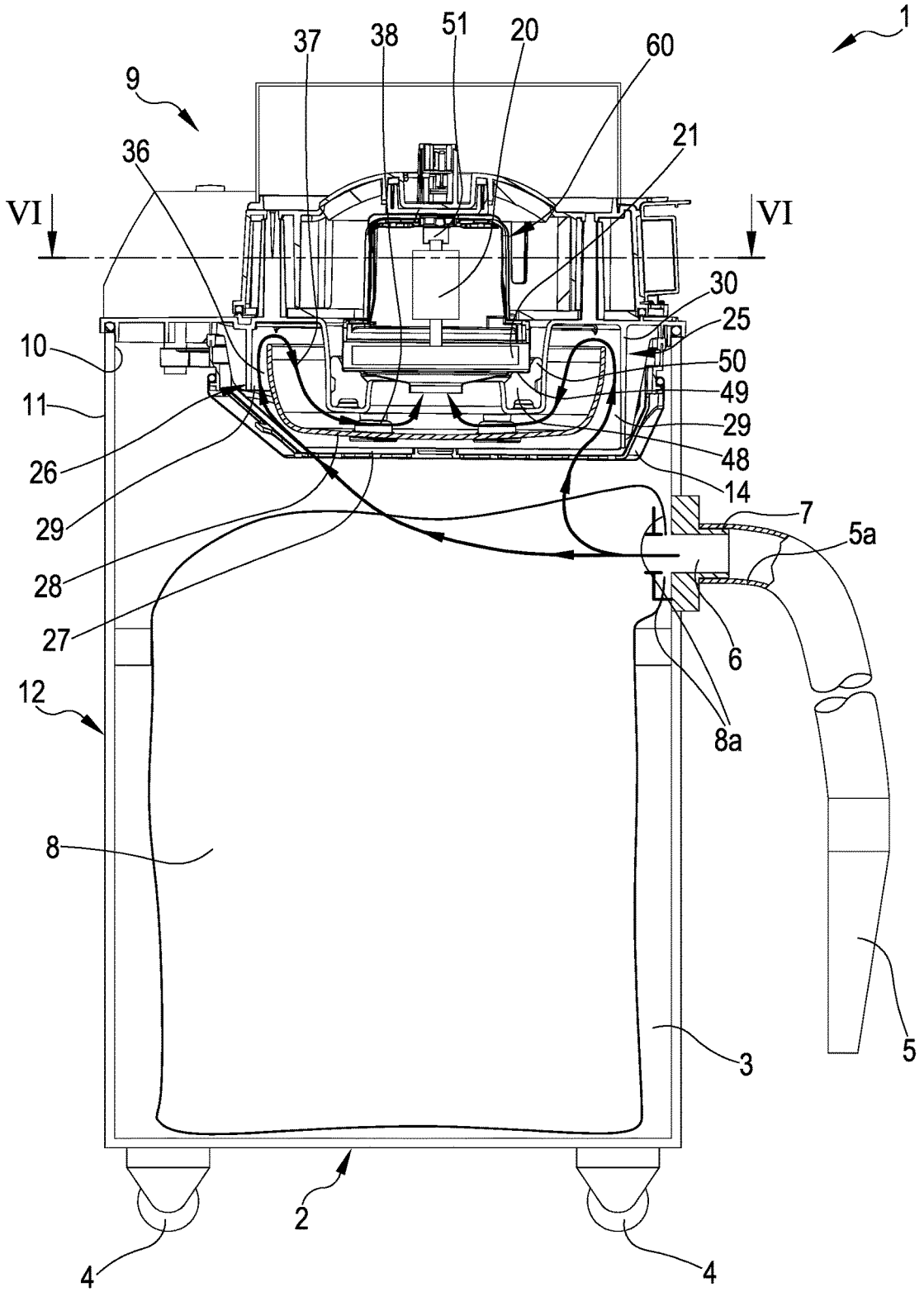
FIG. 1 shows a schematic sectional view made along a vertical plane of a vacuum cleaner according to aspects of the invention.

With reference to FIG. 1, a vacuum cleaner 1 comprises a container 2 delimiting an inner collection volume 3. The container 2 may be equipped with one or more wheels 4 or other systems, such as casters or tracks, allowing the container to be displaced during use. As shown in FIG. 1, a suction hose 5 is attached to the container 2: for example the container 2 may be provided with an aperture 6 provided with a connector 7 configured for coupling with a connecting end 5*a* of the suction hose 5. A collecting bag 8 may be housed inside the vacuum cleaner container 2: the collecting bag 8 may be of the type having a single inlet opening 8*a* configured to be tightly engaged at the aperture 6 present in the container 2 such as to receive the debris collected via the suction hose 5. The bag 8 is for example made in a material permeable to air but capable of trapping the debris including small solid particles and dust. Thus, the bag 8 works as a filter such that air and collected debris are forced via aperture 6 into the collecting bag, which traps the collected debris allowing passage of air through the bag wall and then out of the vacuum cleaner 1 as it will be herein below described in detail.

The vacuum cleaner 1 comprises a head assembly designated with reference numeral 9: in the example shown, the head assembly 9 is located at the top side of the vacuum cleaner 1 and is tightly engaged in correspondence of a main opening 10 delimited by a top border 11 of the side wall 12 of the container 2. It should be understood, however, that the container could be designed in a manner different from what is shown in FIG. 1: for example the container 2 may present a main opening located on the side wall of the container and the head assembly 9 would therefore emerge or extend from the side wall of the container 2.

The head assembly 9 of the presently disclosed non limiting embodiment is detachable from container 2, e.g. by means of latches 13 (see FIGS. 4-6) interacting between the head assembly 9 and the container 2 such that the head assembly can be separated from the container and thus allow a user to access the collection volume and the collecting bag (if present). It should be understood that other alternative solutions may be envisaged: for instance the head assembly 9 may be coupled to the container 2 in a way to be displaceable or rotatable relative to the container from a position where the head assembly 9 closes the main opening 10 to a position where it leaves the main opening 10 accessible from the outside. Also, in accordance with a further alternative, the head assembly 9 may be fixed to the container 2.

Figure 4:
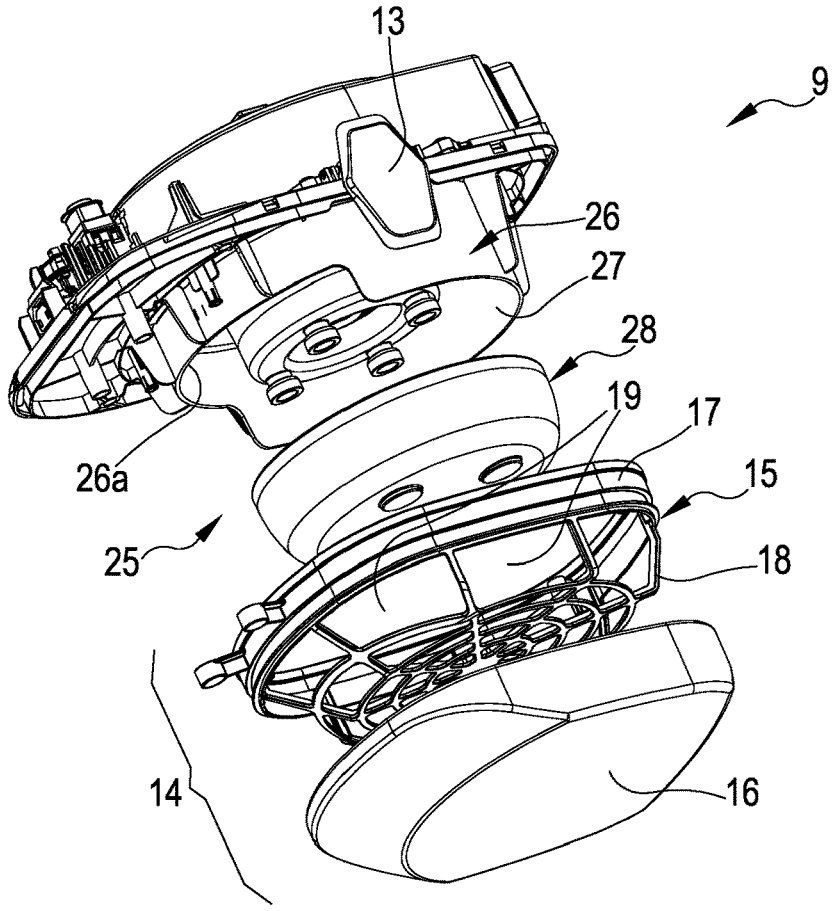
FIG. 4 is an exploded perspective view of a top part of the vacuum cleaner of FIG. 1.

As shown in FIG. 4, the vacuum cleaner 1 may also include a filter 14 extending across the main opening 10 of the container 2 and interposed between the container 2 and the head assembly 9. In accordance with a possible aspect, the filter 14 may include a support structure 15 configured for carrying a filtering membrane 16: the support structure 15 may include a peripheral frame 17 coupled, for instance detachably coupled, to the head assembly 9, and a grid portion 18 fixed to the peripheral frame 17 and presenting a plurality of through apertures 19. The filtering membrane 16, which may be made of fabric, mat, cloth, paper or other suitable material and which has a laminar conformation, is positioned on the support structure 15 to cover the grid portion 18 and is peripherally coupled to the peripheral frame 17. In accordance with a further aspect, the support structure 15 and therefore the filter 14 may present a basket like overall conformation such that, when the head assembly 9 is coupled to the container 2, the filter 14 presents a concavity directed towards the head assembly (i.e., referring to the figures, towards the top of the vacuum cleaner) while a preponderant part of the grid portion (or the whole grid portion) and thus a preponderant part of the filter (or the whole filter) extend inside the collection volume.

As shown in FIGS. 1 to 4, the head assembly 9 comprises a suction unit 60 provided with a motor 20 and an impeller 21 coupled with the motor: the motor may be an electric motor, while the impeller may include one or more rotors coupled to the motor and each provided with a plurality of blades. In accordance with an aspect, the impeller 21 and the motor 20 are arranged one behind the other in an axial direction defining a central axis of symmetry 100, which is also the axis of rotation of the impeller 21.

Figure 2:
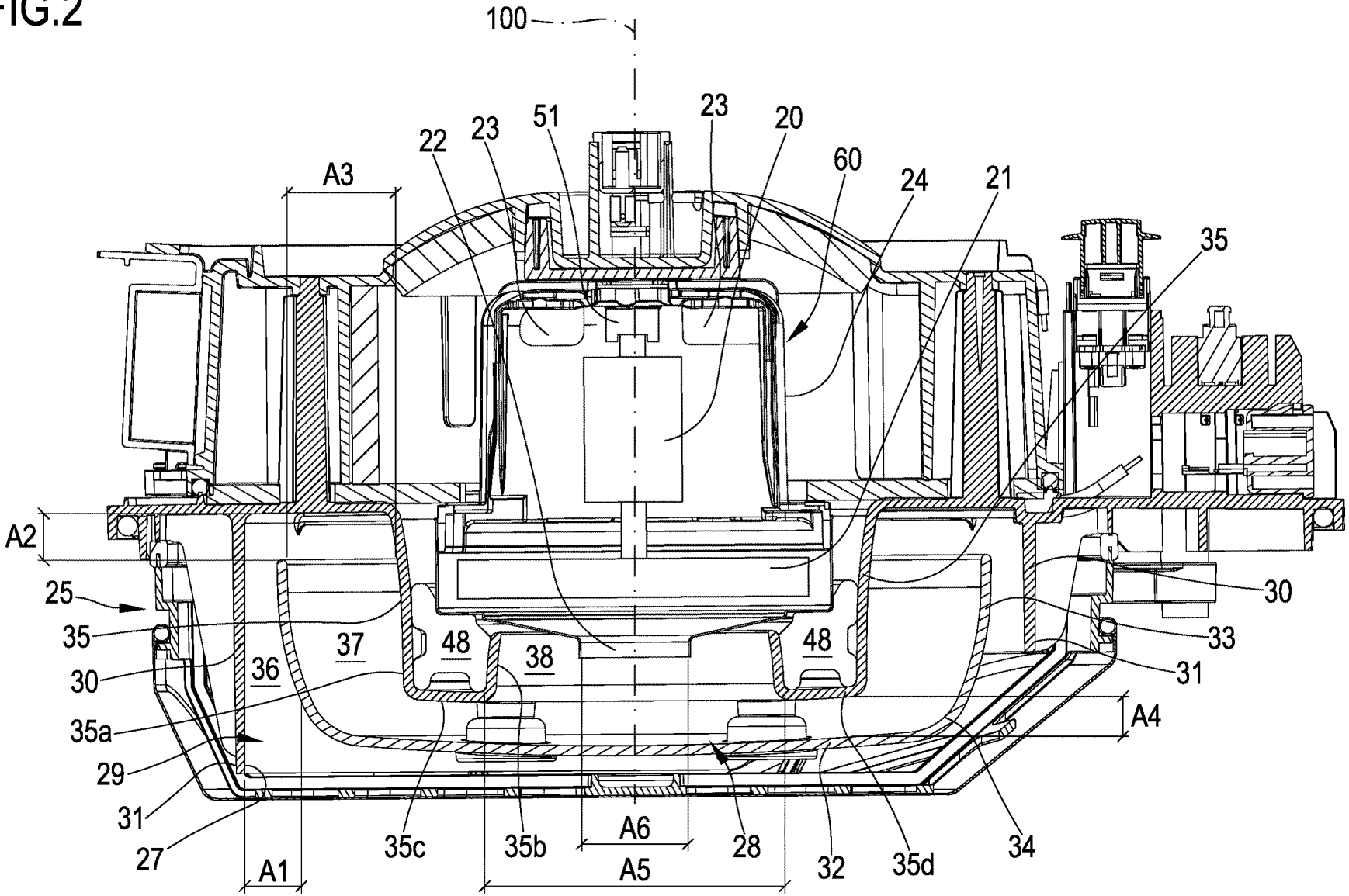
FIG. 2 is a sectional view of a top part of the vacuum cleaner of FIG. 1, taken along plane II-II of FIG. 6.
Figure 3:
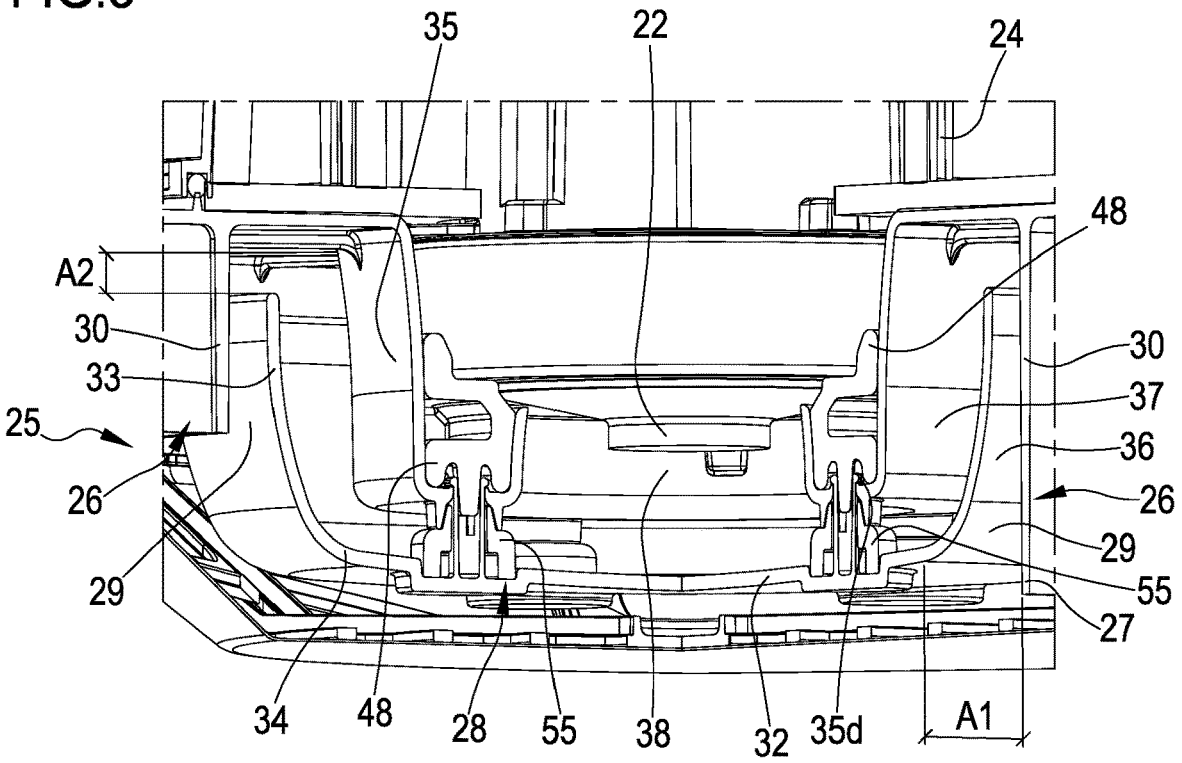
FIG. 3 shows further enlarged sectional view of a particular of the top part of the vacuum cleaner of FIG. 1.

The suction unit 60 has at least one inlet port 22, which is located at the inlet side of the impeller, and at least one outlet port 23, which is located at an outlet side of the impeller: in the example shown in FIG. 2, the suction unit is enclosed in an own casing 24 and has one single axially positioned inlet port 22 and a plurality of outlet ports 23 angularly spaced the one from the other.

The head assembly 9 also comprises an air channeling unit 25 which, in use conditions, is operative between the container 2 and the suction unit 60; the air channeling unit 25 has an intake side facing the inner collection volume 3: in the example shown, when the head assembly 9 is coupled to the container 2, the air channeling unit 25 develops inside the top portion of the collection volume 3, just above the filter 14 (see FIG. 1). In particular, as it is visible from FIGS. 1, 2 and 4, the filter 14 envelops the entire intake side of the channeling unit 25, such that all air sucked in by the suction unit goes through the filter 14 before reaching the air channeling unit 25. In other embodiments, the air channeling unit 25 is not enveloped by the filter 14, but is merely downstream of a filter 14.

In accordance with aspects of the invention, the air channeling unit 25 comprises a collector 26, having a suction mouth 27 at said intake side of the air channeling unit, and a deflector 28, positioned at said intake side and radially extending at least over a central portion of the suction mouth: more in detail—in the example shown—the collector 26 and the deflector 28 delimit a suction channel 29 which places into fluid communication the suction mouth 27 with the inlet port 22 of the suction unit 60. As it is visible in particular from FIG. 1, the suction mouth 27 delimited by the collector extends—in use—transversally (horizontally) in proximity of the main opening 10 of the container 2: the suction mouth 27 has a radial size equal or smaller than the radial size of the main opening 10, but greater than the radial size of the deflector 28; on the other hand, the deflector 28 covers a substantial portion of the suction mouth and has a radial size greater than that of the inlet port 22 of the suction unit and greater than the radial size of the impeller 21.

Going into further structural detail, and again referring mainly to FIGS. 1, 2, and 4, the collector 26 presents a peripheral wall 30 having a front edge 31 delimiting an outer perimeter of the suction mouth 27: in the exemplifying embodiment shown the peripheral wall has a cylindrical conformation such that the outer perimeter of the suction mouth takes a rounded, optionally circular, conformation. Note that in the illustrated embodiment, the peripheral wall 30 of the collector 26 presents an indent **26*a* reducing the axial length of the peripheral wall at least for a portion of the peripheral wall perimeter in order to leave more room for allowing accommodation of a bag top portion. In other embodiments, the peripheral wall 30** may extend a uniform axial length about its entire perimeter.

The deflector 28 presents a base wall 32, directed transverse to the peripheral wall 30 of the collector 26, and a side wall 33 emerging from a periphery of the base wall 32 and extending transverse to the base wall 32: the side wall 33 of the deflector 28 develops adjacent to and radially inside the peripheral wall 30 of the collector 26. The base wall 32 and the side wall 33 of the deflector are joined by curved wall portion 34 such that the deflector presents a continuous and uninterrupted structure substantially having a bowl shape configured to facilitate air flow deflection from the center to the periphery of the deflector and thus into the suction channel 29.

More in detail, the deflector base wall 32 forms a non-flat, convex, operative surface directed in use towards the collection volume 3 and having convexity facing the bottom of the collection volume 3 (i.e., concave towards motor 20) to facilitate air flow deflection towards the periphery of the base wall 32 as described above.

As already mentioned, the collector 26 and the deflector 28 cooperate to define the suction channel 29. In particular, the collector 26 may comprise an inner wall 35, which is located radially inside the peripheral wall 30 of the same collector. Inner wall 35 includes an exterior wall portion **35*a* facing peripheral wall 30, an interior wall portion 35*b* facing inlet port 22 and a shoulder 35*c* extending therebetween. As it is visible from FIG. 2, the side wall 33 of the deflector 28 is positioned between the peripheral wall 30 and the inner wall 35** of the collector such that the following tracts may be identified in the suction channel:

i. a first tract 36 starting immediately downstream the suction mouth 27 and upwardly extending between the side wall 33 of the deflector and the peripheral wall 30 of the collector;
ii. a second tract 37 consecutive to and downstream of the first tract 36 and downwardly extending between the exterior wall portion **35*a* of inner wall 35 of the collector and the side wall 33** of the deflector, and
iii. a third tract 38, consecutive to and downstream of the second tract 37, upwardly directed within interior wall portion **35*b* and placing into fluid communication an end of the second tract 37 with the inlet port 22** of the suction unit.

In accordance with a further aspect of the invention, tracts 33, 37 and 38 are configured as follows:

i. the first tract 36 defines a flow volume of tubular shape and presents—in the flow direction (i.e., moving upwardly with reference to the drawing of FIG. 2)—a continuously decreasing fluid passage cross section;
ii. the second tract 37 which is directly consecutive to the first tract also defines a flow volume of tubular shape and presents; also the second tract 37 has a continuously decreasing fluid passage cross section in the flow direction (i.e., moving downwardly with reference to the drawing of FIG. 2);

iii. the third tract 38 defines a flow volume of non-tubular conformation with substantially constant cross section. In a variant also the third tract may have tubular conformation.

In practice air is sucked in the container 2 under the action of the impeller 21 and efficiently flows through the relatively wide suction mouth 27. Then, air impacts on the surface of the deflector 28 and is diverted into the suction channel 29 where the air flow takes the shape of a continuous and undulated tubular flow volume along the first and second tracts 36, 37 undergoing acceleration, deceleration and acceleration again. Then, the tubular flow volume converges into a non-tubular airflow volume when reaching the third tract and, subsequently, is moved towards the suction unit and enters into the suction unit inlet port. Once inside the suction unit, air moves through the impeller 21 and along an outside of the motor 20 reaching the outlet port or ports 23 of the suction unit 60. Air coming from the outlet port or ports of the suction unit 60 is collected by an exhaust unit 39 (see FIGS. 5 and 6), which discharges the airflow to the environment outside the vacuum cleaner, as it will be herein below described in further detail.

Referring again to FIGS. 2 and 3, various tract widths (first width A1, second width A2, third width A3, fourth width A4, fifth width A5, are illustrated. Tract width A1 represents a width of first tract 36 between the side wall 33 of the deflector and the peripheral wall 30 of the collector. Tract width A2 represents a width of the fluid flow transition over the end of side wall 33 and between first tract 36 and second tract 37. In this transition section, the airflow transitions from a substantially vertical flow through first tract 36 to a substantially horizontal flow over side wall 33 and inward towards second tract 37. Tract width A3 represents a width of second tract 37 between the inner wall 35 of the collector and the side wall 33 of the deflector. Tract width A4 represents a width of the fluid flow transition over the end of exterior wall portion 35*a* of inner wall 35 and between second tract 37 and third tract 38. In this transition section, the airflow transitions from a substantially vertical flow through second tract 37 to a substantially horizontal flow between shoulder 35*c* and deflector 28 inward towards third tract 38. Tract width A5 represents the width or diameter of interior surface 35*b* and tract width A6 represents the diameter of inlet port 22. The relative size of the tract widths A1-A6 can be designed to control airflow through air channeling unit 25 to minimize noise.

For instance, the first tract 36 may present an initial portion having a fluid passage cross section width A1 sensibly greater than the fluid passage cross section width A2. For example, the ratio of cross section widths A1/A2 may be 1.3 or higher. The second tract 37 may present an initial portion having fluid passage cross section width A3 greater than the fluid passage cross section width A2. For example, the ratio of cross section widths A3/A2 may be 1.3 or higher. On the other hand, the initial portion fluid passage cross section width A3 of the second tract 37 may be sensibly greater than the fluid passage cross section width A4. For example, the ratio of cross section widths A3/A4 may be 1.3 or higher. Furthermore, the third tract 38 may presents a fluid passage cross section width A5 greater, in particular constantly greater, than the fluid passage cross section width A4. In particular, the ratio of cross section widths A5/A4 may be 1.3 or higher. Finally, the fluid passage cross section width A5 of the third tract 38 may be substantially constant and also sensibly greater than the fluid passage cross section width A6 of the inlet port 22 of the suction unit. For example, the ratio of cross section widths A5/A6 may be 1.3 or higher. The above configuration allows an efficient acceleration and deceleration of the flow with consequent compression and rarefaction of air which contributes to dampening noise.

It should be noted that according to a further aspect, the first tract, the second tract and the third tract 36, 37, 38 are all positioned and configured such as to be symmetric with respect to an ideal plane of symmetry passing through said central axis of symmetry and of rotation 100 of the impeller.

In particular, the deflector 28 and the collector 26 present a geometry of a solid of revolution and are substantially coaxially positioned and symmetric with respect to said ideal plane: consequently, as shown in FIG. 2 the first tract, the second tract, the third tract and the inlet port are concentrically positioned thus conferring symmetry to the incoming airflow. Moreover, the air channeling unit 25 is compact and occupies a small volume due, in part, to the fact that the first tract, the second tract and the third tract 36, 37, 38 are concentric and intersect a horizontal plane common to the inlet 22. In other embodiments, the first tract, the second tract, and the third tract may be concentrically positioned but lack complete cylindrical symmetry about axis 100. For instance, deflector 28 and collector 26 may be oblong or elliptical in shape when viewed from above or below head 9.

In accordance with another aspect of the invention, the deflector 28 is suspended in the middle of the suction mouth and supported by a number of connecting elements 55 active on a side of the deflector opposite the collection volume 3. Thanks to this provision, the first tract and the second tract form together a continuous tubular flow volume, which—proceeding radially from outside to inside—defines an upwardly and then downwardly directed continuous and uninterrupted flow path: in other words no elements positioned across the flow path defined by the first and second tract disturb the incoming airstream.

The connecting elements 55, which connect the deflector to the collector may be made in elastomeric material and are positioned such as to connect the deflector 28 the inner wall 35, optionally to a radially inner terminal portion (shoulder 35*c*) of the inner wall.

Figure 5:
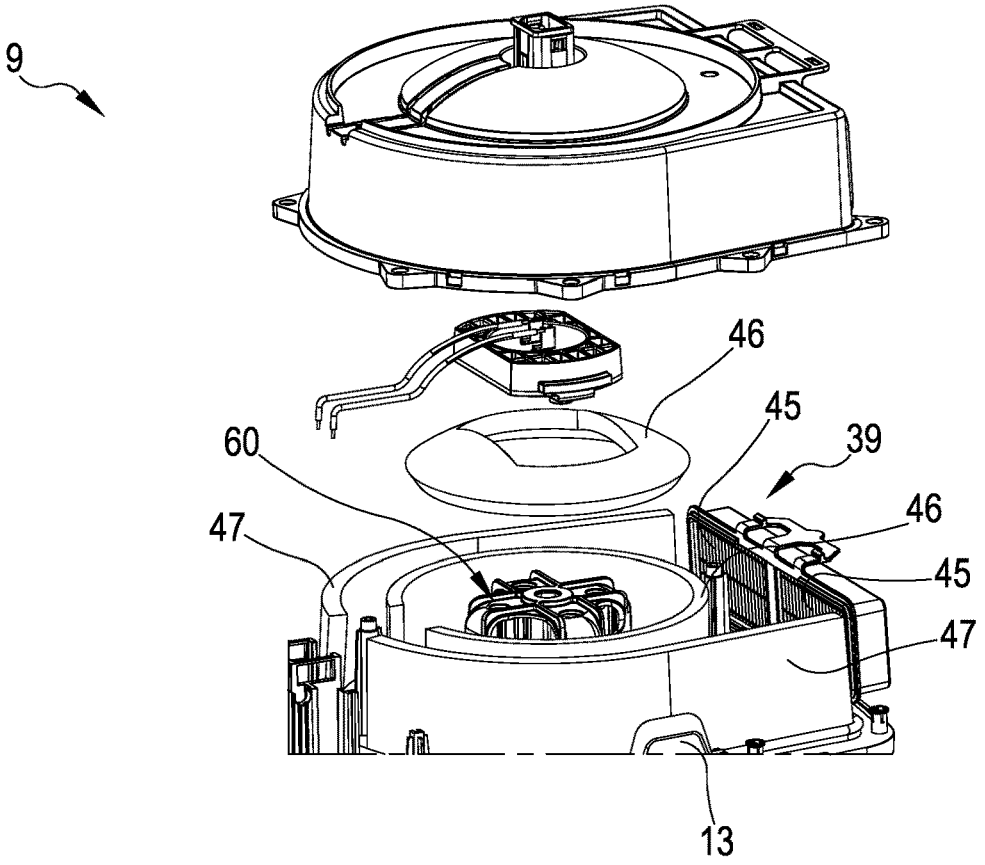
FIG. 5 is an exploded perspective view of a top part of the vacuum cleaner of FIG. 1 seen from a different angle compared to the perspective view of FIG. 4.
Figure 6:
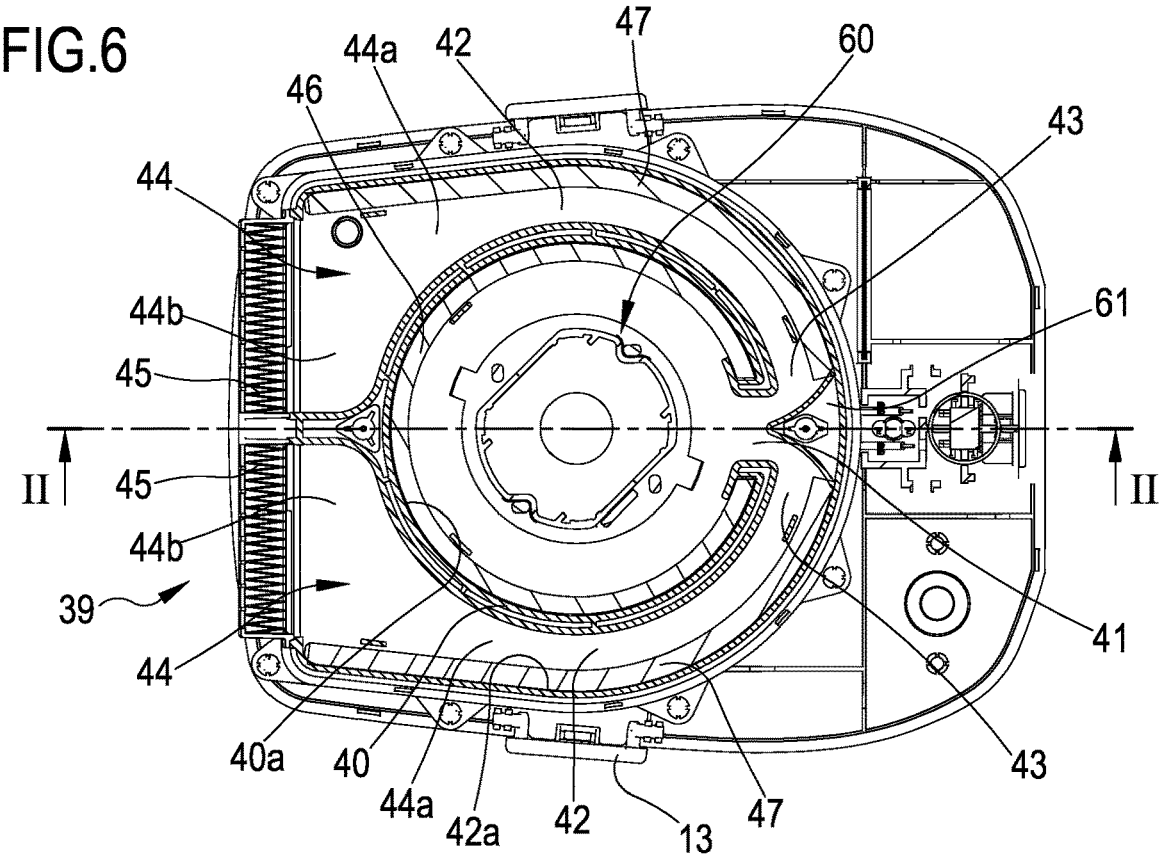
FIG. 6 is a schematic cross sectional view of a top part of the vacuum cleaner of FIG. 1 taken along plane VI-VI of the same FIG. 1.

According to a further aspect, and referring now to FIGS. 5 and 6, the vacuum cleaner 1 also comprises exhaust unit 39, which is positioned on a delivery side of the air channeling unit 25 opposite to said intake side: in practice the exhaust unit 39 is located downstream the suction unit 60 (with reference to a direction of the air flow during operation of the suction unit) while the air channeling unit 25 is located upstream of the suction unit 60. The exhaust unit 39 defines a collection chamber 40 forming a substantially annular airflow volume concentric with said suction unit 60 and positioned around the outlet port or ports 23 of the suction unit 60 to collect air coming from the impeller and convey collected air to an outlet port 41 of the collection chamber, which is for example located on a side wall of the chamber 40. The exhaust unit 39 also includes two symmetrically opposed exhaust channels 42 connected to the outlet port 41 of the collection chamber. Each of the two exhaust channels 42 surrounds a respective portion of the collection chamber: more in detail, as shown in the mentioned figures, each of the two exhaust channels 42 has an intake end 43, located in correspondence of the outlet port 41 of said collection chamber 40, and an outlet end 44, opposed to the intake end 43, configured to discharge air drawn in by the suction unit. In order to split flow exiting from the outlet port 41, the exhaust unit may presents a V shaped flow diverter 61. An outlet filter 45 may be located in correspondence of each one of the outlet ends of the exhaust channels. According to a specific aspect, the outlet end 44 of each of the two exhaust channels is separate and spaced from the outlet end 44 of the other of the two exhaust channels 42 thereby forming two distinct and spaced apart air discharge openings, such that air discharged by each channel does not mix with air discharged by the other channel thereby minimizing turbulence. Also, the outlet end 44 of each exhaust channel may comprises a diverging portion 44*a* designed to slow down flow speed: this portion 44*a* is divergent in shape proceeding away from the intake end 43 and terminates into a constant cross section portion 44*b* consecutive to the diverging portion and leading to the zone where each of the mentioned outlet filters 45 is located. In this way before passing through the outlet filters air has been efficiently reduced in speed and flow made regular, perpendicular to the outlet filters front surface and uniform in speed.

In order to further reduce noise propagation an alveolar pad 46, optionally a foam pad, covers an inner surface 40*a* of the collection chamber 40 surrounding the suction unit 60: as shown in the figures the alveolar pad substantially covers majority if not all the exposed inner surface of the collection chamber. A further alveolar pad 47, optionally a further foam pad, may be provided to cover the inner surfaces 42*a* of said two exhaust channels 42 facing the collection chamber.

In accordance with an additional aspect, the suction unit 60 is supported within the vacuum cleaner in a way that further contributes to reduce noise generation and which is particularly simple to manufacture and assemble. In greater detail and referring to FIGS. 1 and 3, the inner wall 35 comprises a radially inner terminal portion forming an annular seat 35*d*, of U-shaped cross section, configured to receive a foot portion of an annular support body 48, optionally made in elastomeric material, having a head portion supporting the suction unit. In particular the head portion of support body 48 acts and contacts an annular perimeter of the casing 24 (FIGS. 2 and 3) of the suction unit 60. More precisely, the head portion of the support body presents a flat annular rest surface 49 receiving a bottom of the casing 24 and an annular containment lip 50 emerging from the rest surface 49 and radially constraining the bottom of the casing 24.

In order to efficiently support the suction unit, the vacuum cleaner includes a further support body 51, optionally in elastomeric material, having a foot portion received in an auxiliary seat of the air exhaust unit and a head portion, which—in cooperation with the head portion of the annular support body 48—supports the suction unit above the container. The further support body 51 has a discoidal shape and its foot portion received in engaged into said auxiliary seat formed on a lid of the air exhaust unit covering said collecting chamber and exhaust channels. The head portion of the further support body has a central recess receiving a corresponding axial protrusion of the suction unit casing in order to axially and radially constrain the top portion of the suction unit. In accordance with an aspect, the further support body 51 and the annular support body 48 are positioned on axially opposed sides of the suction unit and are coaxially disposed whereby the central axis 100 is axis of common symmetry for the annular support body and the further support body.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and the scope of the appended claims.

The invention claimed is:

1. A vacuum cleaner comprising:

a container delimiting an inner collection volume;

a suction unit provided with a motor and an impeller coupled with the motor, the suction unit having at least one inlet port at an impeller inlet side, and at least one outlet port at an impeller outlet side; and an air channeling unit operative between the container and the suction unit, the air channeling unit having an intake side facing the inner collection volume, wherein the air channeling unit comprises: a collector having a suction mouth at said intake side of the air channeling unit, the collector comprising a peripheral wall having a front edge delimiting an outer perimeter of the suction mouth and an inner wall, which is located radially inside the peripheral wall, the inner wall including an exterior wall portion facing the peripheral wall, an interior wall portion facing the inlet port and a shoulder extending therebetween, a deflector positioned at said intake side and radially extending at least over a central portion of the suction mouth, the collector and the deflector delimiting a suction channel connecting the suction mouth to the inlet port of the suction unit; wherein the suction channel comprises a first tract, a second tract, and a third tract, wherein the first tract and second tract comprise continually tubular volume; and wherein on a first side of the shoulder opposite the collection volume, the shoulder receives an annular support body that supports a first axial end the suction unit and further wherein on a second opposite side of the shoulder facing the collection volume, a number of connecting elements extend between the shoulder and a side of the deflector opposite the collection volume such that the deflector is suspended in the middle of the suction mouth.

2. The vacuum cleaner of claim 1, wherein the deflector comprises a base wall and a side wall, the base wall directed transverse to the peripheral wall of the collector, and the side wall emerging from a periphery of the base wall and extending transverse to the base wall.

3. The vacuum cleaner of claim 2, wherein the deflector base wall has a non-flat, convex active surface, with convexity facing the collection volume configured to facilitate airflow deflection towards the periphery of the base wall, wherein a curved wall portion connects the base wall to the side wall, substantially conferring a bowl shape to the deflector, said curved wall portion being configured to facilitate air flow deflection into the suction channel, and wherein the suction mouth has a radial size greater than that of the deflector and the deflector has a radial size greater than that of the suction unit inlet port or the impeller.

4. The vacuum cleaner of claim 2, wherein the first tract starting at the suction mouth and upwardly developing between the side wall of the deflector and the peripheral wall of the collector, wherein the first tract delimits a respective airflow volume of tubular shape and proceeding in the flow direction presents a continuously decreasing fluid passage cross section.

5. The vacuum cleaner of claim 4, and wherein the side wall of the deflector is positioned between the peripheral wall and the inner wall of the collector, the second tract consecutive to and downstream of the first tract proceeding in the flow direction, wherein the second tract extends downwardly between the inner wall of the collector and the side wall of the deflector, further wherein the second tract delimits a respective airflow volume of tubular shape and proceeding in the flow direction presents a continuously decreasing fluid passage cross section.

6. The vacuum cleaner of claim 5, wherein the second tract presents an initial portion having width (A3) of fluid passage cross section greater than the fluid passage cross section of width (A2) of the end portion of the first tract.

7. The vacuum cleaner of claim 5, wherein the upwardly directed third tract, consecutive to the second tract and placing into fluid communication an end of the second tract with the inlet port of the suction unit, further wherein the third tract delimits a respective airflow volume of non-tubular shape.

8. The vacuum cleaner of claim 7, wherein the third tract has a width (A5) of fluid passage cross section greater than the fluid passage cross section of width (A4) of the end portion of the second tract and greater than the fluid passage cross section of the width (A6) of the inlet port of the suction unit.

9. The vacuum cleaner of claim 7, wherein the impeller and the motor are arranged one behind the other in an axial direction defining a central axis of symmetry and wherein the first tract, the second tract and the third tract are positioned and configured such as to be symmetric with respect to an ideal plane of symmetry passing through said central axis of symmetry and rotation of the impeller.

10. The vacuum cleaner of claim 9, wherein the deflector and the collector present a geometry of a solid of revolution, are coaxially positioned, and are symmetric with respect to said central axis of symmetry.

11. The vacuum cleaner of claim 7, wherein the first tract, the second tract, the third tract and the inlet port are concentrically positioned so that the air channeling unit has a maximum axial extension in the direction of the central axis of symmetry defined by a maximum axial extension of the peripheral wall of the collector.

12. The vacuum cleaner of claim 7 wherein the suction channel presents a first width (A1) of first tract, a second width (A2) of fluid flow transition over the end of side wall and between first tract and second tract, a third width (A3) of second tract, a fourth width (A4) of fluid flow transition over the end of an exterior wall portion of inner wall and between second tract and third tract, a fifth width (A5) of interior wall portion of inner wall, and a sixth width (A6) of inlet port, wherein the ratio of first and second widths (A1/A2) is 1.3 or higher; the ratio of third and second widths (A3/A2) is 1.3 or higher; the ratio of third and fourth widths (A3/A4) is 1.3 or higher; the ratio of fifth and fourth widths (A5/A4) is 1.3 or higher; and the ratio of fifth and sixth widths (A5/A6) is 1.3 or higher.

13. The vacuum cleaner of claim 7, wherein the first tract, the second tract and the third tract are concentric and intersect a plane defined by an opening to the inlet port.

14. The vacuum cleaner of claim 7, wherein the suction unit is configured and positioned relative to the air channeling unit such that when the motor is operated the impeller causes a suction flow which sequentially follows the following flow path: from the inner collection volume through the suction mouth, then upwardly through the first tract, then downwardly through the second tract, then upwardly through the third tract, then upwardly through the inlet port of the suction unit, the impeller and along an outside of the motor.

15. The vacuum cleaner of claim 1 comprising an exhaust unit that further comprises: a collection chamber defining a substantially annular airflow volume that is concentric with said suction unit and positioned around one or more outlet ports of the suction unit to collect air coming from the impeller and convey collected air to an outlet port of the collection chamber; and two symmetrically opposed exhaust channels, each of the two channels surrounding a respective portion of the collection chamber and having an intake end in correspondence of the outlet port of said collection chamber, and an outlet end opposed to the intake end to discharge air drawn in by the suction unit; wherein the outlet end of each of the two exhaust channels is separate and spaced from the outlet end of the other of the two exhaust channels thereby forming two distinct and spaced apart air discharge openings.

16. The vacuum cleaner of claim 15, wherein the first side of the shoulder of the inner wall of the collector forms annular seat configured to receive afoot portion of the annular support body having a head portion supporting the first axial end the suction unit, and wherein a further support body has a foot portion received in an auxiliary seat of the exhaust unit and a head portion active on a second axial end of the suction unit axially opposite to the first axial end, the head portion of the further support body in cooperation with the head portion of the annular support body maintaining the suction unit above the container.

17. The vacuum cleaner of claim 1, wherein the annular support body and the connecting elements are made in elastomeric material.

18. The vacuum cleaner of claim 2, comprising a suction hose configured to be connected at an aperture of the container and a collecting bag configured to be housed inside the container and presenting an inlet opening configured to be tightly engaged at the aperture present in the container such as to receive the debris collected via the suction hose, and wherein the collector presents an indent reducing an axial length of the peripheral wall at least for a portion of a peripheral wall perimeter.

19. The vacuum cleaner of claim 1, comprising a head assembly including at least the suction unit, and the air channeling unit removably coupled to a main opening of the container, and a filter extending across the main opening of the container and interposed between the container and the head assembly, further wherein the filter includes a support structure carrying a filtering membrane, wherein the support structure presents a peripheral frame detachably coupled to the head assembly, and a grid portion fixed to the peripheral frame and presenting a plurality of through apertures, and wherein the filter has a basket-like overall conformation such that, when the head assembly is coupled to the container, the filter extends at least in part inside the collection volume and presents a concavity directed towards the head assembly.

20. A vacuum cleaner comprising:

a container delimiting an inner collection volume; a suction unit provided with a motor and an impeller coupled with the motor, the suction unit having at least one inlet port at an impeller inlet side, and at least one outlet port at an impeller outlet side; and an air channeling unit operative between the container and the suction unit, the air channeling unit having an intake side facing the inner collection volume, wherein the suction channel comprises a first tract, a second tract, and a third tract, wherein the first tract and second tract comprise continually tubular volume;

wherein the vacuum cleaner further comprises an exhaust unit comprising: a collection chamber defining a substantially annular airflow volume concentric with said suction unit and positioned around one or more outlet ports of the suction unit to collect air coming from the impeller and convey collected air to an outlet port of the collection chamber, and two opposed exhaust channels, each of the two channels surrounding a respective portion of the collection chamber and having an intake end in correspondence of the outlet port of said collection chamber and a respective outlet end opposed to the intake end to discharge air drawn in by the suction unit; wherein the exhaust unit comprises a V-shaped flow diverter positioned in front of said outlet port of the collection chamber and configured to divide the flow exiting from the same outlet port into respective flow streams directed into said two exhaust channels.

21. The vacuum cleaner of claim 20, wherein the two exhaust channels are symmetrically opposed and substantially identical the one to the other.

22. The vacuum cleaner of claim 20, wherein the outlet end of each of the two exhaust channels is separate and spaced from the outlet end of the other of the two exhaust channels thereby forming two distinct and spaced apart air discharge openings.

23. The vacuum cleaner of claim 22, wherein a respective outlet filter is located at each outlet end of each one of the two exhaust channels.

24. The vacuum cleaner of claim 20, wherein the vacuum cleaner comprises a pad covering an inner surface of the collection chamber surrounding the suction unit.

25. The vacuum cleaner of claim 20, wherein the vacuum cleaner comprises a pad at least covering inner surfaces of said two exhaust channels facing the collection chamber.

26. The vacuum cleaner of claim 20, wherein the outlet end of each exhaust channel comprises a diverging portion which is divergent in shape proceeding away from the intake end and a constant cross section portion consecutive to the diverging portion.

27. The vacuum cleaner of claim 26, further comprising: outlet filters located in correspondence of each one of the outlet ends of the exhaust channels; wherein the constant cross section portion has a flow passage cross section sensibly larger than that of the intake end and terminates at the outlet filters conferring to air flow a direction perpendicular to a front surface of each one of said outlet filters.

* * * * *